US007001177B1

(12) United States Patent
Alemany et al.

(10) Patent No.: US 7,001,177 B1
(45) Date of Patent: Feb. 21, 2006

(54) METHOD AND APPARATUS FOR RECOVERING ENERGY FROM WASTE MATERIALS BY COMBUSTION USING A PORTION OF TERTIARY AIR

(76) Inventors: José Torres Alemany, Lomas De San Agustin 360 Int. 108, Col.Del Refugio, San Pedro Garza Garcia, N.L. (MX); Enrique Ramón Martinez Vera, Rio Amacuzac No. 1112, Col. Del Valle, San Pedro Garza Garcia, N.L. (MX)

( * ) Notice: Subject to any disclaimer, the term of this patent is extended or adjusted under 35 U.S.C. 154(b) by 0 days.

(21) Appl. No.: 11/149,229

(22) Filed: Jun. 10, 2005

(51) Int. Cl.
*F27B 15/08* (2006.01)

(52) U.S. Cl. ..... 432/61; 432/58; 432/106

(58) Field of Classification Search ..... 432/61, 432/58, 14, 106, 69; 110/245, 346; 122/7 R; 106/700

See application file for complete search history.

(56) References Cited

U.S. PATENT DOCUMENTS

| | | | | |
|---|---|---|---|---|
| 3,732,064 | A * | 5/1973 | Jaquay | 432/13 |
| 4,720,262 | A * | 1/1988 | Durr et al. | 432/106 |
| 5,156,676 | A | 10/1992 | Garrett et al. | |
| 5,816,795 | A | 10/1998 | Hansen et al. | |
| 6,470,812 | B1 * | 10/2002 | Arroyave-Garcia et al. | 110/346 |
| 6,875,015 | B1 * | 4/2005 | Tiernan | 432/106 |
| 2002/0035804 | A1 | 3/2002 | Garcia-Secovia et al. | |
| 2003/0150161 | A1 | 8/2003 | Garcia-Segovia et al. | |

FOREIGN PATENT DOCUMENTS

| | | |
|---|---|---|
| EP | 0 764 614 | 3/1997 |
| GB | 2 034 014 | 5/1980 |

* cited by examiner

*Primary Examiner*—Gregory A. Wilson
(74) *Attorney, Agent, or Firm*—Young & Thompson

(57) ABSTRACT

A method and apparatus for using in rotary kilns having a calciner and a tertiary air duct, which uses the hot air from the tertiary air duct for burning waste material in a combustion chamber formed therein, achieving a complete combustion of the waste material and discharging the hot combustion gas to the tertiary air duct for its use as supplemental energy source by the rotary kiln.

30 Claims, 3 Drawing Sheets

METHOD AND APPARATUS FOR RECOVERING ENERGY FROM WASTE MATERIALS BY COMBUSTION USING A PORTION OF TERTIARY AIR

BACKGROUND OF THE INVENTION

A. Field of the Invention

The present invention is related to rotary kilns, used in the cement or similar industries having a calciner and a tertiary air duct and more particularly to a method and apparatus which uses the hot air from the calciner tertiary air feeding duct for burning waste material and recovering the energy from the burned material.

B. Background of the Invention

The necessity to reduce total fuel costs through the substitution of waste-derived fuels instead the normal fossil fuels, primarily coal or pet coque, has been the main driving force behind the desirability of cheap alternative fuels to fire industrial kilns such as rotary kilns for producing cement.

In previous art, alternative solid fuels are normally fed at the kiln entrance. The amount and characteristics of alternative solid fuels which can be burned in the industrial kiln such as discarded tires and industrial waste depends on the amount of available oxygen at the kiln entrance.

In kilns having a calciner, only about the 50% of the total amount of oxygen provided to the industrial kiln is feed to the kiln and the other 50% is feed to the calciner, which considerably restricts the amount of waste material that can be burned as alternative solid fuel.

When the waste material is burned at the kiln entrance, the oxygen in such place, which is between 3 to 5%, is consumed, producing a reducing atmosphere which favours the formation of solid scales on the kiln and calciner wall thus reducing the overall efficiency of the industrial kiln.

There have been developed many external combustion chambers or gasifiers which try to avoid the above referred problem, but since the acquisition, implementation and overall operational cost of such apparatuses are high the use of an external device is not completely desirable.

An attempt to use alternative solid fuels without reducing the amount of oxygen at the kiln and without using an external combustor or gasifier, has been made by injecting and burning the waste material directly into the tertiary air duct which is described in the U.S. Pat. No. 6,470,812.

U.S. Pat. No. 6,470,812 describes a method and apparatus to recover energy from waste preferably solids whether in bulk or crushed, such as vehicle tires, bags, bales, bulk material that may be contained in tanks, barrels, etc. by means of combustion of such waste in industrial furnaces, particularly of the rotary type, that has an external calciner, feeding such waste into the tertiary air duct of the calciner and burning the waste inside the duct itself.

The method further discloses removing from the tertiary air duct any solid residues remaining therein from the decomposed waste and the apparatus comprises a feed mechanism for external charging of the waste directly into said tertiary air duct and a separating mechanism for removing from the tertiary air duct any solid residues remaining therein from decomposed waste.

As stated by the U.S. Pat. No. 6,470,812, the feed to the duct preferably should be about 1 to 5 meters from its discharge end. Since feeding waste material to the exhaust gas outlet results in build up of encrustations, the feed to the tertiary air duct should be sufficiently remote from the duct discharge into the exhaust gas to allow adequate residence time of the waste-derived products in the duct to prevent such build up from occurring.

However it may be possible that some of the waste material end up burning near the exhaust gas, specially when feeding big pieces of waste material such as whole tires, thus producing encrustations and requiring periodic plant shut down for its removal. Therefore it is very important that the waste material be feed in small batches of material in order to guarantee that such small batches burn completely before arriving to the exhaust gas outlet. It is clear that the use of batches of whole tires by the above referred system is very restricted.

Furthermore, since the above referred system teaches to remove detritus such as the steel wires from car tires, if amount of wire is excessive, it may become entangled and the mechanism for removing any solid residues may have problems to handle the entangled wire.

Therefore it would be highly desirable to have a system which can be able to burn high amounts of waste material including whole tires, without producing a reducing atmosphere at any point of the industrial kiln nor the formation of solid scales on the kiln or calciner wall.

In view of the above referred need, applicant developed a method and apparatus which uses a less than 10% of the hot tertiary air in order to burn the waste material, specially whole tires and which further incorporates to the cement clinker any material that may be compatible in cement such as steel wires from tires.

Applicant's apparatus comprise: one or more combustion chambers formed into the calciner tertiary air feeding duct, each having releasable retaining means therein for retaining the waste material inside the combustion chamber until a complete combustion is achieved since at this point there is an excess of oxygen of more than a 300% and the air temperature is between 650° to 950° C., said releasable retaining means allowing the flow of combustion gas and air trough itself; and one or more feeding means each connected to a combustion chamber for feeding waste material to the combustion chamber further avoiding the loss of heat or the inlet of cold air from the exterior into the hot tertiary air stream trough the feeding means.

Similarly applicant's method comprises: burning waste material inside a combustion chamber formed into the calciner tertiary air feeding duct using a fraction of tertiary air and retaining the material therein for a predetermined amount of time for allowing a complete decomposition of the combustible portion of the waste and a complete combustion of the waste achieved since at this point there is an excess of oxygen of more than a 300% and the air temperature is between 650° to 950° C.

The main advantage of applicant's apparatus and method comprises the fact that the whole combustion process is carried out inside the calciner tertiary air feeding duct, which completely avoids the possibility of burning the waste material at the kiln entrance or in any other place of the kiln.

Since the non combustible material is directly feed by gravity to the combustion chamber, there is no need to have means for retiring any remaining material, and remaining material such as steel from tires can be fully used and incorporated in the cement clinker.

Furthermore, the modification of current rotary kilns in order to be adapted to use the apparatus of the present invention is not complicated, and since the system is not comprised by complicated equipment, the acquisition, implementation and operational costs are very low.

With the apparatus of the present invention, it is achieved a decrease of pet coque consume of from 10 to 30% per combustion chamber.

SUMMARY OF THE INVENTION

It is therefore a main object of the present invention to provide a method and apparatus for recovering energy from waste materials by combustion using hot tertiary air in which the whole combustion process is carried out inside combustion chambers formed inside the tertiary air duct.

It is another main object of the present invention to provide a method and apparatus of the above disclosed nature which completely avoids the possibility of burning the waste material near the kiln entrance or in any other place of the kiln.

It is still a main object of the present invention to provide a method and apparatus of the above disclosed nature, in which any remaining material such as steel from tires can be fully used and incorporated in the cement clinker.

It is still another main object of the present invention to provide an apparatus of the above disclosed nature, which is not complicated to install and is not comprised by complicated equipment.

It is an additional object of the present invention to provide a method and apparatus of the above disclosed nature in which the acquisition, implementation and operational costs are very low.

It is a further object of the present invention to provide a method and apparatus of the above disclosed nature by which it is achieved a decrease of pet coque consume of from 10 to 30% per combustion chamber.

These and other objects and advantages of the a method and apparatus for recovering energy from waste materials by combustion using hot tertiary air of the present invention will become apparent to those persons having an ordinary skill in the art, from the following detailed description of the embodiments of the invention which will be made with reference to the accompanying drawings.

DETAILED DESCRIPTION OF THE INVENTION

The invention will be described referring to a preferred embodiment thereof, illustrated in the accompanying drawings wherein the same signs and numbers, refer to the same parts of the shown figures.

The apparatus and method of the present invention is intended to be used in rotary kilns for the production of cement having a calciner and a tertiary air duct.

Figure 1:
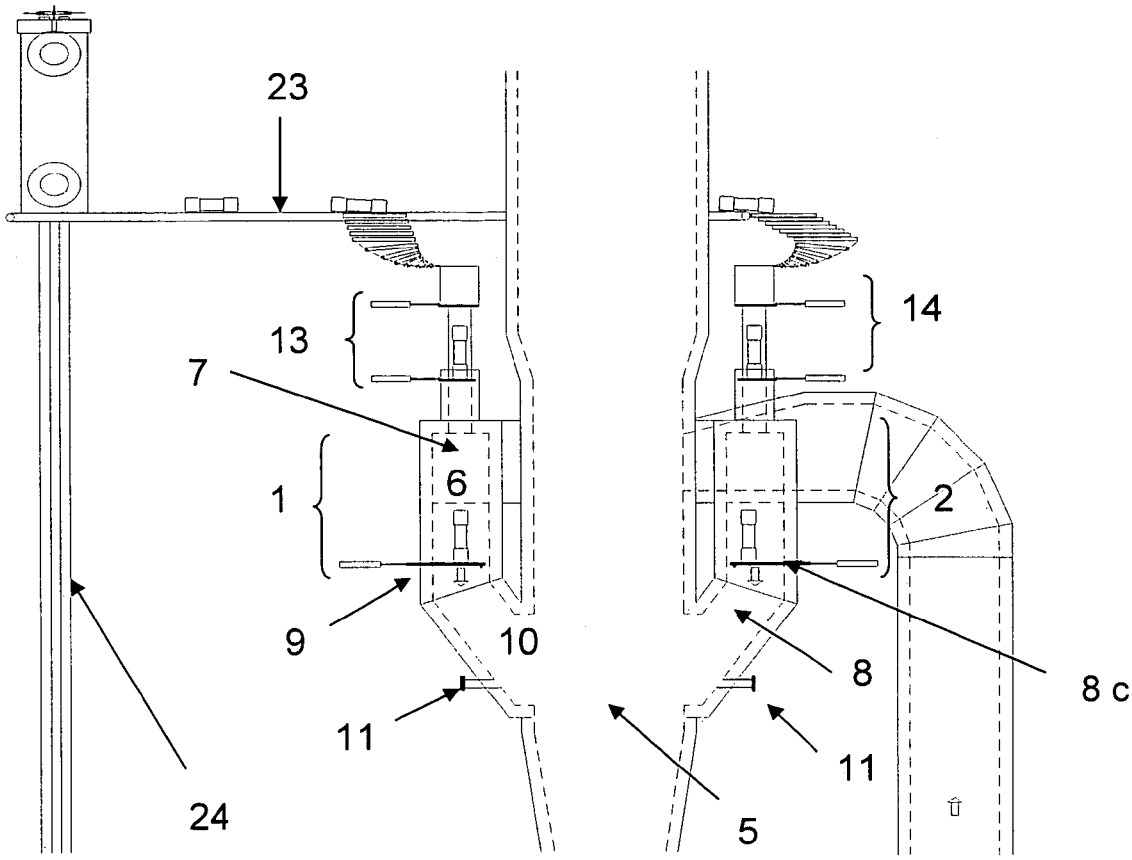
FIG. 1. is a front view of the cross section of the apparatus of the present invention.
Figure 2:
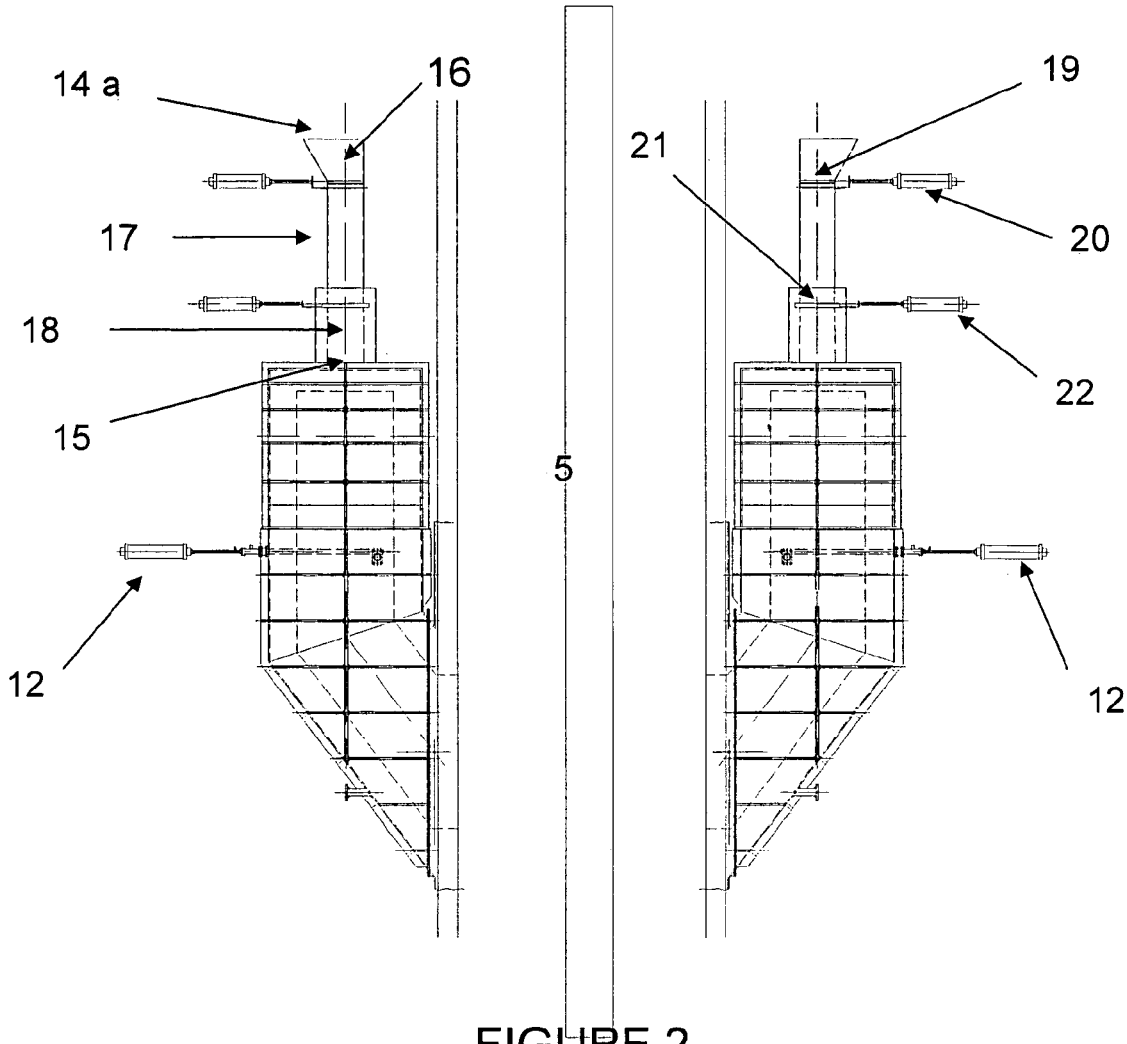
FIG. 2. is another front view of the cross section of the apparatus of the present invention.
Figure 3:
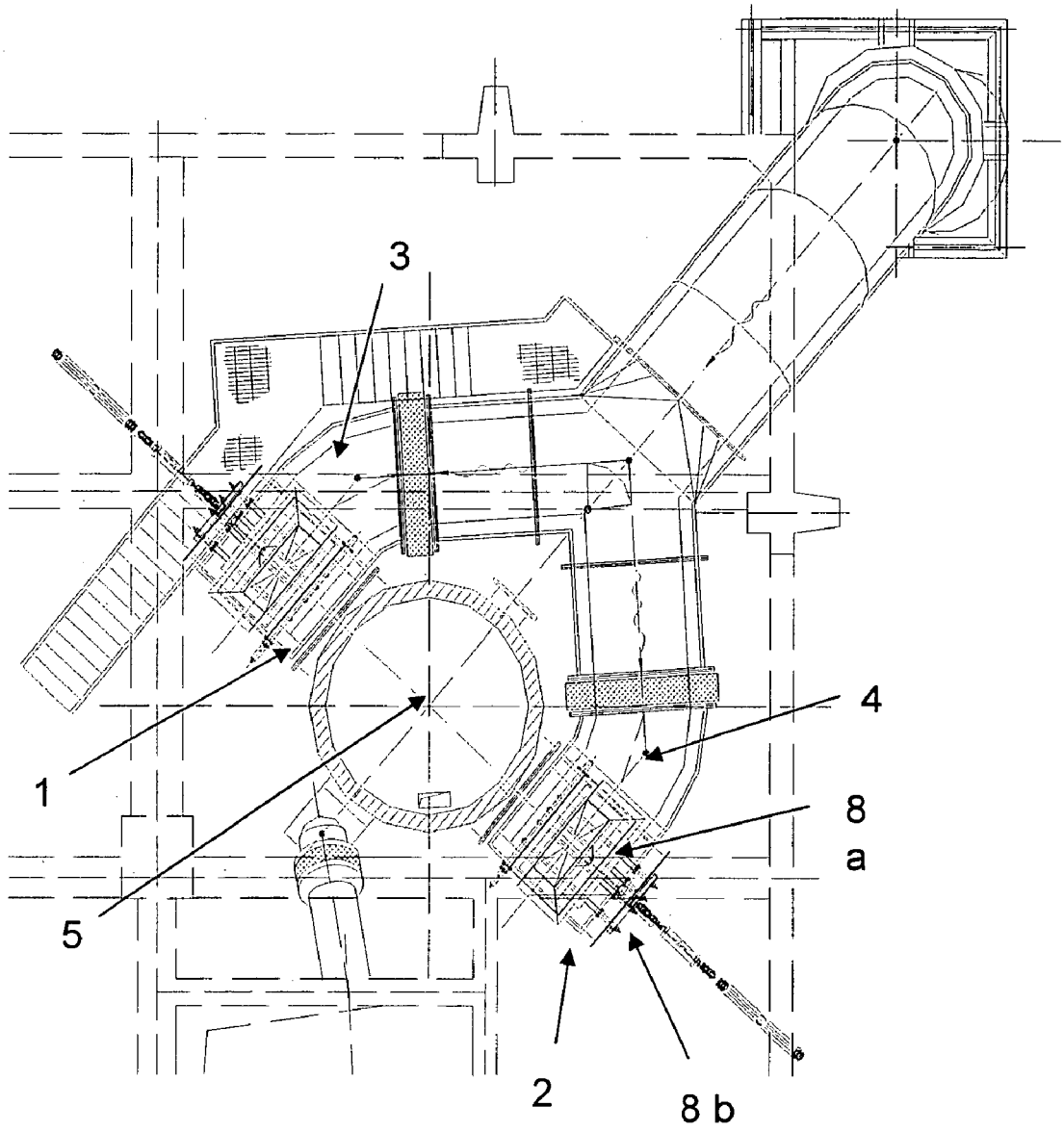
FIG. 3. is an upper view of the apparatus of the present invention.

Referring to FIG. 1, FIG. 2 and FIG. 3 the apparatus for recovering energy from waste materials by combustion using tertiary air of the present invention comprises a first 1 and a second 2 combustion chamber both directly formed inside a first 3 and a second 4 tertiary air feeding duct respectively of the calciner 5 each comprising a duct having a quadrangular cross section, and each combustion chamber having:

a combustion portion 6 vertically oriented, including a charge opening 7 at a superior end, and an inferior end 8;

a grill type water cooled sliding retaining valve 9, comprised by four water cooled sliding rods 8*a* connected by a horizontal connection member 8*b*, each rod passing trough a perforation 8*c* located at the inferior end 8 of the combustion portion 6;

a gas and wire discharge portion 10 prolonging from the inferior end of the combustion portion 6, directly connected to the calciner 5, wherein the discharge portion 10 comprise a discharge portion of the tertiary air feeding ducts 3, 4 which is inclined towards the calciner 5 in order to reach and connect to the calciner 5 and having fossil fuel feeding means 11 located near the connection with the calciner; and means for sliding in and out the grill type water cooled sliding retaining valve comprising a hydraulic or pneumatic piston 12 connected to an end of the horizontal connection member for pushing or retry the retaining valve 9 in or out of the combustion chamber 1, 2;

first 13 and a second 14 feeding and sealing means for feeding tires to the charge opening 7 of the first 1 and second 2 combustion chamber respectively, each comprising:

a vertical conduct having a quadrangular cross section, having: a feeding aperture 14*a* at a superior end, a discharge opening 15 directly and hermetically connected to the charge opening 7 of the combustion portion 6 of a combustion chamber 1, 2, an open receiving section 16, a middle charge chamber 17 and a discharge section 18;

first valve means, comprising a first sliding quadrangular gate 19 which can be a horizontal slide in (for a closed position) and out (for an opened position) of the vertical conduct, located at an inferior end of the open receiving section 16, and when closed, the gate completely isolates the other sections of the vertical conduct from the exterior;

means for sliding in and out the first sliding quadrangular gate, comprising a hydraulic or pneumatic piston 20 that pushes or withdraw the first sliding quadrangular gate 19 inside or out the vertical conduct;

water cooled valve means comprising a water cooled sliding quadrangular gate 21 which can be horizontally slid in (for a closed position) and out (for an opened position) of the vertical conduct, located at a bottom end of the middle charge chamber 17 and when closed, the gate 21 completely isolates the superior sections of the vertical conduct from the discharge section 18 and combustion chamber 1, 2;

means for sliding in and out the second siding quadrangular gate, comprising a hydraulic or pneumatic piston 22 that pushes or withdraws the gate 21 inside or out the vertical conduct;

delivering means, for delivering the whole tires directly to the open receiving section feeding aperture of the first 1 and second 2 combustion chamber feeding means, comprising an horizontal conveyor belt 23 located at the same level of the feeding apertures 14 and an elevator 24 for elevating the tires from the ground level to the conveyor belt level 23 and delivering the tires to the conveyor belt 23.

The batches of whole tires are delivered to the open receiving section 16 feeding aperture 14*a* of the feeding and sealing means 13, 14 of each combustion chamber 1, 2, and are received inside the open receiving section 16 and retained therein by means of the first sliding quadrangular gate 19 which is in a closed position.

Once the middle charge chamber 17 is able to receive a batch of tires, the first sliding quadrangular gate 19 is opened by its respective hydraulic or pneumatic piston 20 and the batch of tires falls to the middle chamber by gravity and is retained therein by the water cooled sliding quadrangular gate 21, and the first sliding quadrangular gate 19 is immediately closed.

Once the combustion chamber 1, 2, is able to process the batch of tires, the water cooled sliding quadrangular gate 21 is opened and the batch of tires falls through the discharge section 18 and enters to the combustion portion 6 of the combustion chamber 1, 2 by gravity through its charge opening 7 and is retained therein by means of the water cooled sliding retaining valve 9, and the water cooled sliding quadrangular gate 21 is immediately closed.

While the water cooled sliding quadrangular gate 21 is at an open position the first sliding quadrangular gate 19 remains closed for avoiding any heat loss or the entrance of cool air from the exterior into the combustion chambers 1, 2.

Once the batch of tires is inside the combustion portion 6 of the combustion chamber 1, 2, it is contacted with hot tertiary air at a temperature of from 650° C. to 900° C. and the ignition of tires is achieved in a time of 2 to 5 seconds after its contact with the hot tertiary air. During the combustion process, a temperature of 1,200 to 1,400° C. is achieved thus destroying all the organic compounds contained in the tires and avoiding the emanation of polluting compounds and achieving a complete combustion of the waste, thanks to an excess of air of more than a 300%.

The grill type water cooled sliding retaining valve 9 allows the flow of air and combustion gases trough itself and controls the residence time of the tires inside the combustion chamber, which is of from 80 to 120 seconds, thus guaranteeing a complete decomposition of the combustible portion of the tires and a complete combustion of the tires. The hot combustion gases and remaining tertiary air are discharged through the gas and wire discharge portion 10 for its use as supplemental energy source by the rotary kiln and the grill type water cooled sliding retaining valve 9 is opened for discharging the remaining tire wire by gravity to the calciner trough the gas and wire discharge portion 10 for its incorporation to the cement clinker as iron oxide.

The typical main pet coque save achieved by each combustion chamber of the apparatus of the present invention is approximately of from 10 to 30% per combustion chamber.

Although it was described that the apparatus of the present invention comprises only two combustion chambers, it may be possible to install more than two combustion chambers and correspondent delivering means for raising the amount of fuel substitution and overall processing capacity of waste material.

The grill type water cooled sliding retaining valve 9 may have any number of rods depending of the size of the waste material to be processed and/or the size of the tertiary air duct.

Although it was described that the first valve means and cooled valve means of the feeding and sealing means 13 comprise a sliding quadrangular gate 19 and a water cooled sliding quadrangular valve 21, they may comprise a gate having any shape, swing gates, or any other suitable valve means.

The waste material that can be processed by the apparatus of the present invention is not limited only to tires. Bulk material that may be contained in tanks, barrels, can also be processed by the apparatus of the present invention. Also mixtures of tires and bulk material can be processed by the apparatus of the present invention.

Since the waste material is retained inside the combustion chamber 1, 2, until a complete decomposition of the combustible portion of the tires and a complete combustion of the tires is achieved, it is avoided that unburned material may reach the calciner or other parts of the rotary kiln and the possibility that the waste material burns in any other place of the kiln lowering the oxygen content and building up of encrustations.

Similarly, the method in accordance with the present invention comprises:

burning waste material inside a combustion chamber formed into the calciner tertiary air feeding duct using a fraction of tertiary air at a temperature of from between about 650° C. to 900° C. and retaining the material therein for a predetermined amount of time for allowing a complete decomposition of the combustible portion of the waste and a complete combustion of the waste thanks to an excess of oxygen of more than a 300%, achieving a combustion temperature of from 1,200° C. to 1,400° C.;

discharging the hot combustion gas to the tertiary air duct for its use as supplemental energy source by the rotary kiln; and discharging remaining material to the tertiary air duct for its incorporation to the cement clinker once a complete combustion of the waste material is achieved.

Finally it must be understood that the method and apparatus for recovering energy from waste materials by combustion using a portion of tertiary air, of the present invention, is not limited exclusively to the embodiments above described and illustrated and that the persons having ordinary skill in the art can, with the teaching provided by the invention, to make modifications to the method and apparatus for recovering energy from waste materials by combustion using a portion of tertiary air of the present invention, which will clearly be within of the true inventive concept and of the scope of the invention which is claimed in the following claims.

What is claimed is:

1. An apparatus for recovering energy from waste materials by combustion using hot tertiary air for using in rotary kilns having a calciner and a tertiary air duct comprising:

one or more combustion chambers formed into the calciner tertiary air feeding duct, each having water cooled releasable retaining means therein for retaining the waste material inside the combustion chamber until a complete combustion is achieved by using a fraction of tertiary air, said water cooled releasable retaining means allowing the flow of combustion gas and air through itself;

one or more feeding means each connected to a combustion chamber for feeding waste material to the combustion chamber further avoiding the loss of heat or the entrance of cool air from the exterior into the combustion chambers through the feeding means; and wherein the combustion chamber delivers hot combustion gas to the calciner for its use as supplemental energy source by the rotary kiln and remaining material in order to be incorporated to the cement clinker.

2. An apparatus for recovering energy from waste materials by combustion using tertiary air as claimed in claim 1, wherein the combustion chamber releasable retaining means comprising a grill type water cooled sliding retaining valve.

3. An apparatus for recovering energy from waste materials by combustion using tertiary air as claimed in claim 1, wherein the feeding means further avoiding the loss of heat or the entrance of cool air from the exterior into the combustion chambers, comprising a plurality of water cooled slidable valves.

4. An apparatus for recovering energy from waste materials by combustion using tertiary air as claimed in claim 1, wherein each combustion chamber comprising a duct, and each combustion chamber having:

a combustion portion vertically oriented, including a charge opening at a superior end and an inferior end; and a gas and wire discharge portion prolonging from the inferior end of the combustion portion, directly connected to the calciner, wherein the discharge portion is inclined with respect to the combustion portion towards the feeding duct in order to reach and connect to said feeding duct;

water cooled valve means located at the inferior end of the combustion portion, allowing the flow of combustion gas and air trough itself; and means for driving the water cooled valve means.

5. An apparatus for recovering energy from waste materials by combustion using tertiary air as claimed in claim 1, wherein each combustion chamber comprising a duct having a quadrangular shaped cross section, and each combustion chamber having:

a combustion portion vertically oriented, including a charge opening at a superior end and an inferior end; and a gas and wire discharge portion prolonging from the inferior end of the combustion portion, directly connected to the calciner, wherein the discharge portion is inclined with respect to the combustion portion towards the feeding duct in order to reach and connect to said feeding duct;

water cooled valve means located at the inferior end of the combustion portion, allowing the flow of combustion gas and air through itself; and means for driving the water cooled valve means.

6. An apparatus for recovering energy from waste materials by combustion using tertiary air as claimed in claim 1, wherein each feeding mean comprising:

a vertical conduct, having: a feeding aperture at a superior end, a discharge opening directly and hermetically connected to the combustion chamber, an open receiving section, a middle charge chamber and a discharge section;

first valve means, located at the top of the open receiving section;

means for driving the first valve means;

cooled valve means, located at the bottom of the middle charge chamber; and means for driving the cooled valve means.

7. An apparatus for recovering energy from waste materials by combustion using tertiary air as claimed in claim 1, wherein each feeding mean comprising:

a vertical conduct having a quadrangular shaped cross section, having: a feeding aperture at a superior end, a discharge opening directly and hermetically connected to the combustion chamber, an open receiving section, a middle charge chamber and a discharge section;

first valve means, located at the top of the open receiving section;

means for driving the first valve means;

cooled valve means, located at the bottom of the middle charge chamber; and means for driving the cooled valve means.

8. An apparatus for recovering energy from waste materials by combustion using tertiary air as claimed in claim 1, wherein each combustion chamber comprising a duct, and each combustion chamber having:

a combustion portion vertically oriented, including a charge opening at a superior end and an inferior end; and a gas and wire discharge portion prolonging from the inferior end of the combustion portion, directly connected to the calciner, wherein the discharge portion is inclined with respect to the combustion portion towards the feeding duct in order to reach and connect to said feeding duct;

valve means allowing the flow of combustion gas and air through itself; and means for driving the valve means, wherein the valve means comprising a cooled grill type sliding retaining valve, comprised by a plurality of sliding rods connected by a horizontal connection member, each rod passing trough a perforation located at the inferior end of the combustion portion.

9. An apparatus for recovering energy from waste materials by combustion using tertiary air as claimed in claim 1, wherein each combustion chamber comprising a duct having a quadrangular shaped cross section, and each combustion chamber having:

a combustion portion vertically oriented, including a charge opening at a superior end and an inferior end; and a gas and wire discharge portion prolonging from the inferior end of the combustion portion, directly connected to the calciner, wherein the discharge portion is inclined with respect to the combustion portion towards the feeding duct in order to reach and connect to said feeding duct;

valve means allowing the flow of combustion gas and air trough itself; and means for driving the valve means;

wherein the valve means comprising a cooled grill type sliding retaining valve, comprised by four water cooled sliding rods connected by a horizontal connection member, each rod passing trough a perforation located at the inferior end of the combustion portion.

10. An apparatus for recovering energy from waste materials by combustion using tertiary air as claimed in claim 1, wherein each combustion chamber comprising a duct, and each combustion chamber having:

a combustion portion vertically oriented, including a charge opening at a superior end and an inferior end; and a gas and wire discharge portion prolonging from the inferior end of the combustion portion, directly connected to the calciner, wherein the discharge portion is inclined with respect to the combustion portion towards the feeding duct in order to reach and connect to said feeding duct;

valve means allowing the flow of combustion gas and air through itself; and means for driving the valve means;

wherein the valve means comprising a cooled grill type sliding retaining valve, comprised by a plurality of water cooled sliding rods connected by a horizontal connection member, each rod passing through a perforation located at the inferior end of the combustion portion; and wherein the means for driving the valve means comprising a pneumatic piston connected to an end of the horizontal connection member for pushing or retry the cooled retaining valve in or out of the combustion chamber.

11. An apparatus for recovering energy from waste materials by combustion using tertiary air as claimed in claim 1, wherein each combustion chamber comprising a duct having a quadrangular shaped cross section, and each combustion chamber having:

a combustion portion vertically oriented, including a charge opening at a superior end and an inferior end; and a gas and wire discharge portion prolonging from the inferior end of the combustion portion, directly connected to the calciner, wherein the discharge portion is inclined with respect to the combustion portion towards the feeding duct in order to reach and connect to said feeding duct;

valve means allowing the flow of combustion gas and air through itself; and means for driving the valve means;

wherein the valve means comprising a cooled grill type sliding retaining valve, comprised by four water cooled sliding rods connected by a horizontal connection member, each rod passing through a perforation located at the inferior end of the combustion portion; and wherein the means for driving the valve means comprising a pneumatic piston connected to an end of the horizontal connection member for pushing or retry the cooled retaining valve in or out of the combustion chamber.

12. An apparatus for recovering energy from waste materials by combustion using tertiary air as claimed in claim 1, wherein each feeding mean comprising:

a vertical conduct, having: a feeding aperture at a superior end, a discharge opening directly and hermetically connected to the combustion chamber, an open receiving section, a middle charge chamber and a discharge section;

first valve means, located at the top of the open receiving section;

means for driving the first valve means;

cooled valve means, located at the bottom of the middle charge chamber;

means for driving the second valve means; and wherein the cooled valve means comprising a cooled sliding gate which can horizontally slide in for a closed position, and slide out for an opened position of the vertical conduct, located at the end of the middle charge chamber and when closed, the gate completely isolates the superior sections of the vertical conduct from the discharge section and combustion chamber.

13. An apparatus for recovering energy from waste materials by combustion using tertiary air as claimed in claim 1, wherein each feeding mean comprising:

a vertical conduct, having a quadrangular shaped cross section and having: a feeding aperture at a superior end, a discharge opening directly and hermetically connected to the combustion chamber, an open receiving section, a middle charge chamber and a discharge section;

first valve means, located at the top of the open receiving section;

means for driving the first valve means;

cooled valve means, located at the bottom of the middle charge chamber;

means for driving the second valve means;

wherein the first valve means comprising a sliding quadrangular gate which can horizontally slide in for a closed position, and slide out for an opened position of the vertical conduct, located at the top of the open receiving section and when closed, the gate completely isolates the middle charge section of the vertical conduct from the exterior; and wherein the cooled valve means comprising a water cooled sliding quadrangular gate which can horizontally slide in for a closed position, and slide out for an opened position of the vertical conduct, located at the end of the middle charge chamber and when closed, the gate completely isolates the superior sections of the vertical conduct from the discharge section and combustion chamber.

14. An apparatus for recovering energy from waste materials by combustion using tertiary air as claimed in claim 1, wherein each feeding mean comprising:

a vertical conduct, having: a feeding aperture at a superior end, a discharge opening directly and hermetically connected to the combustion chamber, an open receiving section, a middle charge chamber and a discharge section;

first valve means, located at the top of the open receiving section;

means for driving the first valve means; and cooled valve means, located at the end of the middle charge chamber;

means for driving the second valve means; and wherein the means for driving the first valve means and cooled valve means each comprising a pneumatic piston that pushes or withdraw a gate inside or out the vertical conduct.

15. An apparatus for recovering energy from waste materials by combustion using tertiary air as claimed in claim 1, wherein each feeding mean comprising:

a vertical conduct, having a quadrangular shaped cross section, having: a feeding aperture at a superior end, a discharge opening directly and hermetically connected to the combustion chamber, an open receiving section, a middle charge chamber and a discharge section;

first valve means, located at the top of the open receiving section;

means for driving the first valve means; and cooled valve means, located at the end of the middle charge chamber;

means for driving the second valve means; and wherein the means for driving the first valve means and cooled valve means each comprising a pneumatic piston that pushes or withdraw a gate inside or out the vertical conduct.

16. An apparatus for recovering energy from waste materials by combustion using tertiary air as claimed in claim 1, wherein each combustion chamber comprising a duct having a quadrangular cross section, and each combustion chamber having:

a combustion portion vertically oriented, including a charge opening at a superior end and three perforations horizontally aligned and located at an inferior end; and a gas and wire discharge portion prolonging from the inferior end of the combustion portion, directly connected to the calciner, wherein the discharge portion is inclined with respect to the combustion portion towards the feeding duct in order to reach and connect to said feeding duct and having a fossil fuel entrance located near the connection with the calciner;

a cooled grill type sliding retaining valve, comprised by four water cooled sliding rods connected by a horizontal connection member, each rod passing through a perforation located at the inferior end of the combustion portion;

means for sliding in and out the grill type sliding retaining valve comprising a hydraulic or pneumatic piston connected to an end of the horizontal connection member for pushing or retry the retaining valve in or out of the combustion chamber;

each feeding means comprising:

a vertical conduct having a quadrangular cross section, having: a feeding aperture at a superior end, a discharge opening directly and hermetically connected to the charge opening of the combustion portion of a combustion chamber, an open receiving section, a middle charge chamber and a discharge section;

first valve means, comprising a first sliding quadrangular gate which can horizontally slide in, for a closed position and out for an opened position of the vertical conduct, located at an end of the open receiving section, and when closed, the gate completely isolates the other sections of the vertical conduct from the exterior;

means for sliding in and out the first sliding quadrangular gate, comprising a pneumatic piston that pushes or withdraw the gate inside or out the vertical conduct;

second valve means comprising a water cooled sliding quadrangular gate which can horizontally slide in for a closed position and out for an opened position of the vertical conduct, located at the end of the middle charge chamber and when closed, the gate completely isolates the superior sections of the vertical conduct from the discharge section and combustion chamber; and means for sliding in and out the cooled sliding quadrangular gate, comprising a pneumatic piston that pushes or withdraw the gate inside or out the vertical conduct.

17. An apparatus for recovering energy from waste materials by combustion using hot tertiary air as claimed in claim 1, further including delivering means, for delivering the waste material directly to the feeding means.

18. An apparatus for recovering energy from waste materials by combustion using hot tertiary air as claimed in claim 10, further including delivering means, for delivering the waste material directly to the open receiving section feeding aperture of the feeding means, comprising an horizontal conveyor belt located at the same level of the feeding aperture and an elevator for elevating the waste material from the ground level to the conveyor belt level and delivering the waste material to the conveyor belt.

19. An apparatus for recovering energy from waste materials as claimed in claim 1, wherein the waste material comprise whole tires.

20. An apparatus for recovering energy from waste materials as claimed in claim 1, wherein the waste material comprise waste material packs.

21. An apparatus for recovering energy from waste materials as claimed in claim 1, wherein the waste material comprise whole tires and waste material packs.

22. A method for recovering energy from waste materials by combustion using tertiary air for using in rotary kilns having a calciner and a tertiary air duct connected thereof comprising:

burning waste material inside a combustion chamber formed into the calciner tertiary air feeding duct using a fraction of tertiary air and retaining the material therein for a predetermined amount of time for allowing a complete decomposition of the combustible portion of the waste and a complete combustion of the waste;

discharging the hot combustion gas to the tertiary air duct for its use as supplemental energy source by the rotary kiln; and discharging remaining material to the tertiary air duct for its incorporation to the cement clinker once a complete combustion of the waste material is achieved.

23. A method as claimed in claim 22, wherein the temperature of the tertiary air is from between about 650 degrees C to to 900 degrees C.

24. A method as claimed in claim 22, wherein the time necessary for achieving a complete decomposition of the combustible portion of the waste and a complete combustion of the waste is: from 80 to 120 seconds.

25. A method as claimed in claim 22, wherein the remaining material is discharged to the tertiary air duct by gravity.

26. A method as claimed in claim 22, wherein it is achieved a combustion temperature of from 1,200 degrees C to 1,400 degrees C.

27. A method as claimed in claim 22, wherein the complete combustion is achieved thanks to an excess of oxygen of more than a 300%.

28. A method as claimed in claim 22, wherein the waste material comprise whole tires.

29. A method as claimed in claim 22, wherein the waste material comprise waste material packs.

30. A method as claimed in claim 22, wherein the waste material comprise whole tires and waste material packs.

* * * * *